US005148484A

United States Patent [19]

Kane et al.

[11] Patent Number: 5,148,484

[45] Date of Patent: Sep. 15, 1992

[54] SIGNAL PROCESSING APPARATUS FOR SEPARATING VOICE AND NON-VOICE AUDIO SIGNALS CONTAINED IN A SAME MIXED AUDIO SIGNAL

[75] Inventors: Joji Kane, Nara; Akira Nohara, Nishinomiya, both of Japan

[73] Assignee: Matsushita Electric Industrial Co., Ltd., Osaka, Japan

[21] Appl. No.: 700,465

[22] Filed: May 15, 1991

[30] Foreign Application Priority Data

May 28, 1990 [JP] Japan ..... 2-138064

[51] Int. Cl.[5] ..... G10L 3/00

[52] U.S. Cl. ..... 381/46; 381/110; 381/56

[58] Field of Search ..... 381/56, 46, 47, 48, 381/110

[56] References Cited

U.S. PATENT DOCUMENTS

| | | | |
|---|---|---|---|
| 4,441,203 | 4/1984 | Fleming | 381/46 |
| 4,541,110 | 9/1985 | Hopf et al. | 381/46 |
| 4,542,525 | 9/1985 | Hopf | 381/56 |
| 4,829,578 | 5/1989 | Roberts | 381/46 |

FOREIGN PATENT DOCUMENTS

| | | |
|---|---|---|
| WO87/00366 | 1/1987 | PCT Int'l Appl. . |
| WO87/04294 | 7/1987 | PCT Int'l Appl. . |

*Primary Examiner*—Dale M. Shaw
*Assistant Examiner*—David D. Knepper
*Attorney, Agent, or Firm*—Wenderoth, Lind & Ponack

[57] ABSTRACT

A signal processing unit separates voice signals and non-voice audio signals contained in a mixed audio signal. The mixed audio signal is channel divided, and the voice signal portions of the channel divided mixed audio signal are detected and extracted at one output. Non-voice audio signals contained in the voice signal portions are predicted based on the non-voice audio signal portions of the mixed audio signal. The thus predicted non-voice audio signals are combined with extracted non-voice audio signals to obtain continuous non-voice audio signals which are output at a second output. Alternately, instead of extracting the voice signals from the mixed audio signal, the predicted non-voice signals are removed from the mixed audio signal to obtain the voice signals which are output on the first output.

2 Claims, 5 Drawing Sheets input waveform
t

Fourier transform
input waveform spectrum
A
t predicting audio spectrum
B
t

A - B
t invert Fourier conversion
output waveform
t
time

SIGNAL PROCESSING APPARATUS FOR SEPARATING VOICE AND NON-VOICE AUDIO SIGNALS CONTAINED IN A SAME MIXED AUDIO SIGNAL

BACKGROUND OF THE INVENTION

The present invention generally relates to a voice/-non-voice audio signal separating apparatus for separating voice signals and non-voice audio signals included in a single mixed audio signal.

Generally, when it is necessary to separately record the singing voices of a singer and the sounds of orchestra instruments at, for example, a concert, exclusive microphones are respectively provided for the separate recording. Further, when such recorded signals are to be transmitted, the separately recorded signals are also transmitted separately.

When mixed voice signals and other audio signals (hereinafter denoted "non-voice audio signals" or simply "audio signals") are required to be separated from each other, there is a problem in that a system for effecting the separating operation which is distant from the location of the recording operation complicates the entire system apparatus.

SUMMARY OF THE INVENTION

Accordingly, an essential object of the present invention is to provide an improved voice/non-voice audio signal separating apparatus which substantially eliminates the disadvantages inherent in the conventional arrangements of this kind.

Another important object of the present invention is to provide a voice/non-voice audio signal separating apparatus which is capable of separating the voice signals and the non-voice signals in the mixed voice/audio signals.

In accomplishing these and other objects, according to a first embodiment of the present invention, a voice/-non-voice audio signal separating apparatus includes a band separating circuit for channel dividing mixed voice/audio signals input thereto, a voice detecting circuit for detecting the voice portion in the thus channel divided signals, a voice section determining circuit for determining the voice signal sections in accordance with the detection results of the voice detecting circuit, and a voice extraction circuit for extracting the voice portions in the mixed voice/audio signals in accordance with the determined voice section. The apparatus further includes an audio signal predicting circuit for receiving the channel divided voice/audio signals and for predicting the audio signals of the voice signal portion based on the data of the audio portion only in accordance with the voice portion information detected by the voice detecting circuit, an audio signal extracting circuit for extracting the audio signals from the channel divided voice/audio signals using the voice portion information detected by voice detecting circuit, and an audio signal continuous connecting circuit for connecting the audio signal portions extracted by the audio signal extraction circuit and the audio signals of the voice signal portions predicted by the audio signal predicting circuit.

According to the second embodiment of the present invention, a voice/non-voice audio signal separating apparatus includes a band separating circuit for channel dividing input voice/non-voice audio signals, a voice detecting circuit for detecting the voice portions in the channel divided signals, an audio signal predicting circuit for predicting audio signals as in the above described first embodiment, a cancelling circuit for removing the audio signals predicted by the predicting circuit from the input channel divided voice/audio signal, and a band compounding circuit for band compounding the outputs from the cancelling circuit. The apparatus further includes an audio signal extraction circuit and an audio signal continuous connecting circuit as in the first embodiment.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
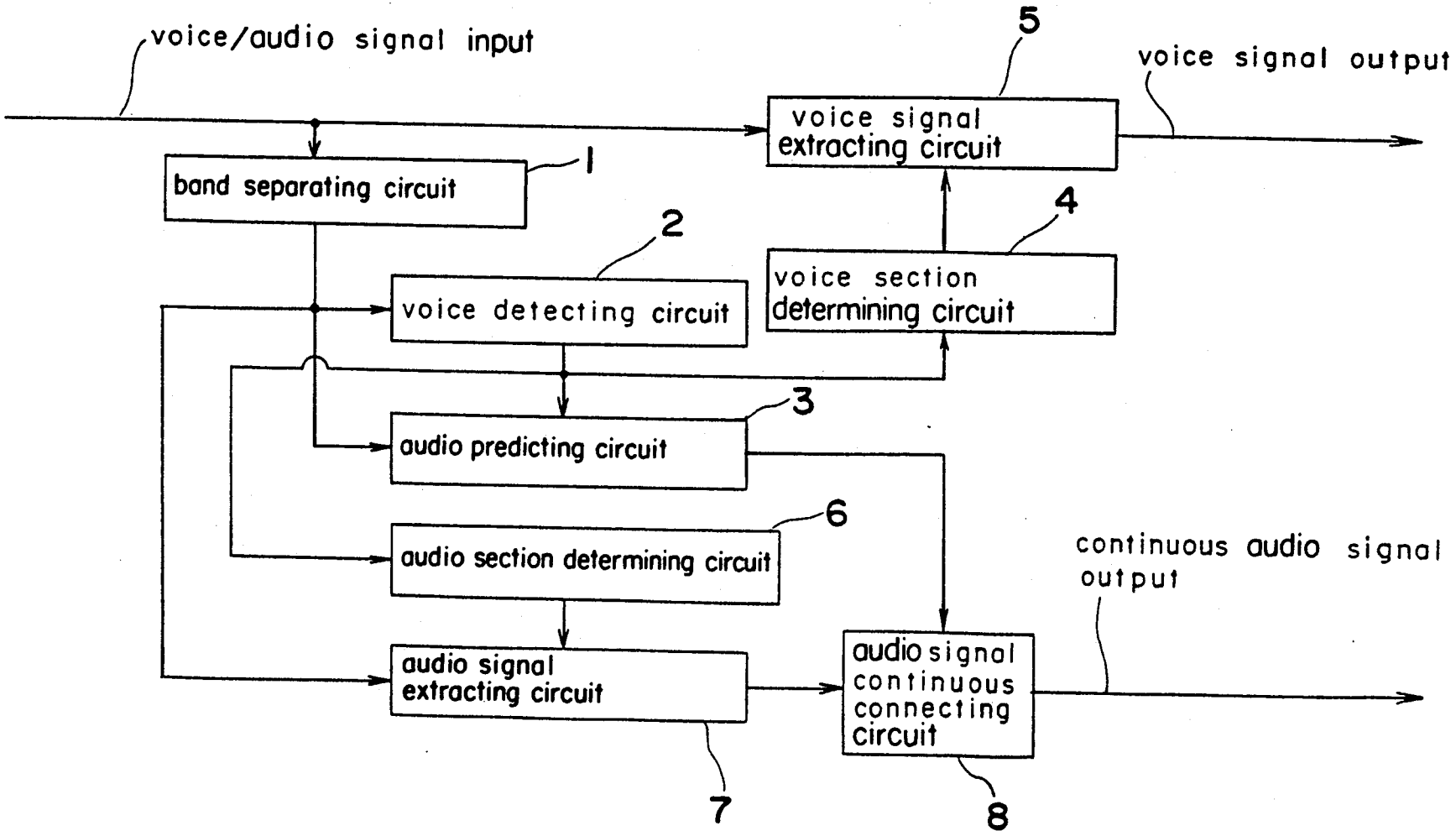
FIG. 1 is a block diagram showing a first embodiment of a voice/non-voice audio signal separation apparatus in accordance with the present invention.

Before the description of the present invention proceeds, it is to be noted that like parts are designated by like reference numerals throughout the accompanying drawings.

FIRST EMBODIMENT

Referring now to the drawings, there is shown in FIG. 1 a schematic block diagram of a first embodiment of a signal processing apparatus in accordance with the present invention.

A band dividing circuit 1 receives the voice signals mixed with the other audio signals and effects a channel separation operation. For example, the circuit 1 is provided with an A/D converter and a Fourier factor converter, and is adapted to pass specified frequency bands.

A voice detecting circuit 2 receives the channel divided voice signals mixed with the other audio signals and detects the voice portions thereof. The circuit 2 distinguishes between the voice portions and the other audio portions using only, for example, filters or the like. Alternately, the circuit 2 effects a Cepstrum analysis to identify the voice portions using peak information, formant information and so on. Namely, the voice detecting circuit 2 is provided with, for example, a Cepstrum analyzing circuit and a voice discriminating circuit.

Figure 3A:
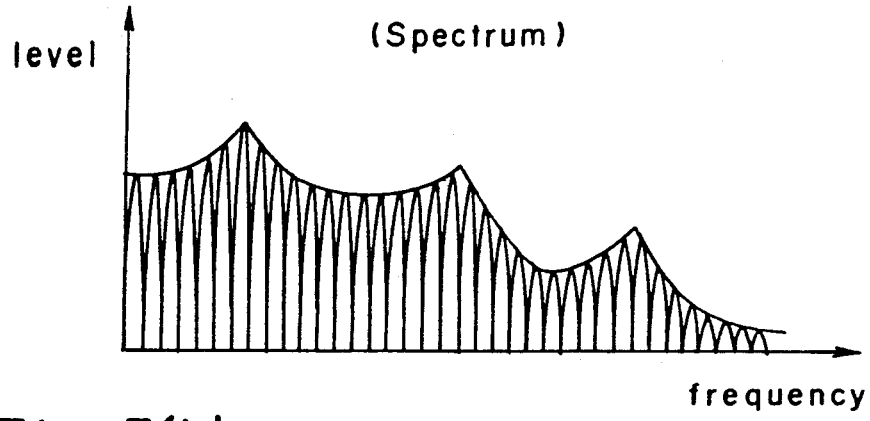
FIGS. 3(*a*) and (*b*) are graphs for describing a Cepstrum analysis of the present invention.
Figure 3B:
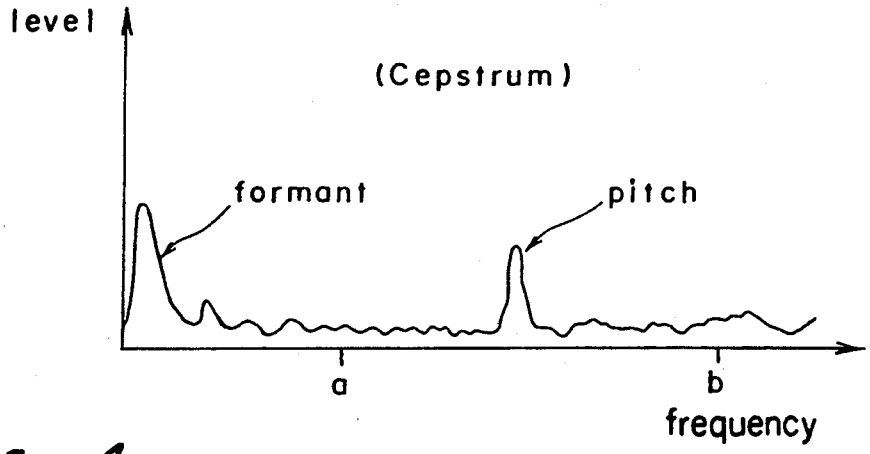

The Cepstrum analyzing circuit obtains the Cepstrum characteristics of the frequency spectrum of the channel divided voice signals mixed with the other audio signals. FIG. 3(*a*) shows the spectrum thereof, and FIG. 3(*b*) shows the Cepstrum thereof.

The voice discriminating circuit discriminates the voice portions in accordance with the Cepstrum characteristics obtained by the Cepstrum analyzing circuit. Specifically, it is provided with a peak detecting circuit, an average value computing circuit, and a voice discriminating circuit. The peak detecting circuit obtains the peak (pitch) of the Cepstrum characteristics obtained by the Cepstrum analyzing circuit. On the other hand, the average value computing circuit computes the average value of the Cepstrum characteristics obtained by the Cepstrum analyzing circuit. The voice discriminating circuit discriminates the voice portions using the peak of the Cepstrum characteristics detected by the peak detecting means and the average value of the Cepstrum characteristics computed by the average value computing circuit. For example, it is adapted to discriminate between vowel sounds and consonant sounds to accurately discriminate the voice portions. Namely, when a signal indicating that a peak has been detected is input from the peak detecting circuit, the input voice signal input is judged to be vowel sound portion. Also, when the Cepstrum average value input from the average value computing circuit is larger than a predetermined prescribed value, or the amount of increase (differential coefficient) of the Cepstrum average value is larger than a predetermined prescribed value, the input voice signal is judged to be a consonant portion. As a result, a voice portion detecting signal denoting a vowel sound/consonant sound or a signal denoting a voice portion including vowel and consonant sounds, is output from the voice detecting circuit 2.

A voice section determining circuit 4 determines the voice portion of the input voice/audio signal, for example, the starting timing of the voice portion and the completing timing thereof, by referring to the voice portion detection signal output from the voice detecting circuit 2.

A voice signal extraction circuit 5 receives the voice signals mixed with the other audio signals and extracts and outputs only the voice portions in accordance with the output from the voice section determining circuit 4. For example, the circuit 5 is composed of a switching circuit.

Figure 4:
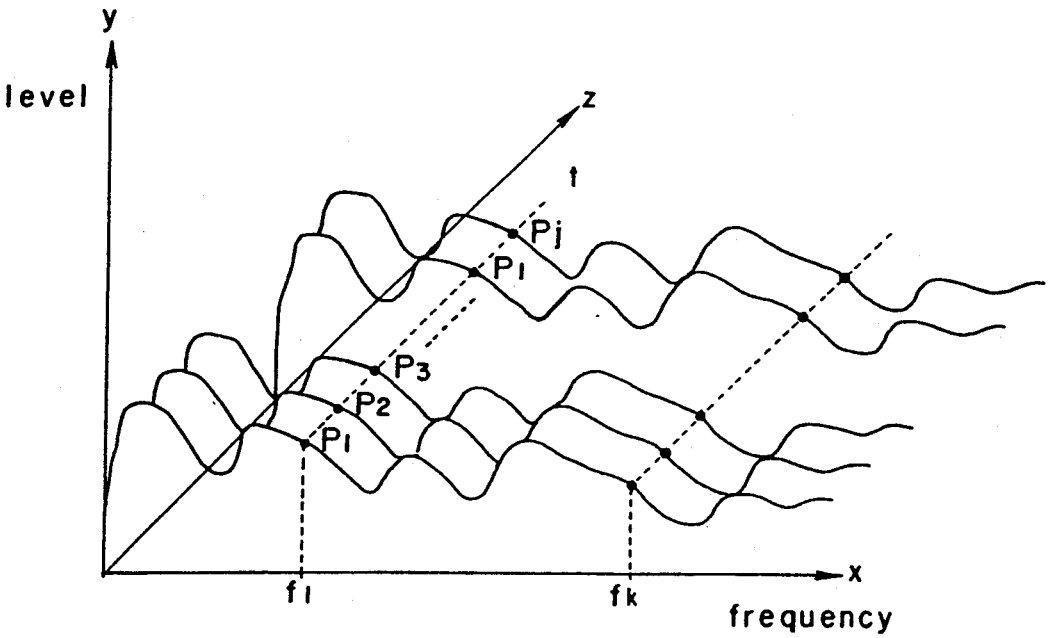
FIG. 4 is a graph for describing a non-voice audio signal prediction technique of the present invention.

An audio signal predicting circuit 3 determines signals as audio portions using the voice portion detection signal from the voice detecting circuit 2 by predicting audio signal data contained in the voice signal portions with the use of the audio signal data of the audio signal portions only. Namely, the audio signal predicting circuit 3 predicts the audio signal components for each channel in accordance with the channel divided voice/audio inputs. As shown in FIG. 4, the x axis denotes frequency, the y axis denotes a voice level, the z axis denotes time. The data p1, p2, ..., pi of a non-voice audio portion provided at the frequency p1 are used to predict the next pj contained in a voice signal portion. For example, the average of the audio signal portions p1 through pi are taken to predict pj contained in a voice signal portion. When the voice signal portion is further continued, pj is multiplied by an attenuation coefficient.

An audio signal portion determining circuit 6 determines the non-voice audio signal portion of the voice/audio input signal, for example, the starting timing of the audio signal and the completing timing thereof, using the voice portion detection signal output by the voice detecting circuit 2.

An audio signal extraction circuit 7 is composed of, for example, a switching circuit and extracts and outputs the non-voice audio signal portions of the channel divided voice/audio signals in accordance with the output of the non-voice audio signal portion determining circuit 6.

A non-voice audio signal continuous connecting circuit 8 combines the non-voice audio signal portions output by the above described audio signal extraction circuit 7 with the audio signal portions of the voice signal portions predicted by the above described audio signal predicting circuit 6 to thus obtain a continuous audio signal. For example, the circuit 8 is composed of a switching circuit driving by timing signals.

The operation in the first embodiment of the present invention will be described hereinafter.

The voice/audio signals, having voice signals mixed with the non-voice audio signals, are received and channel divided by the band dividing circuit 1. The voice detecting circuit 2 detects the voice signal portions of the channel divided voice/audio signals. The voice section determining circuit 4 determines the voice signal portions of the voice/audio signals in accordance with the detection results of the voice detecting circuit 2. The voice extraction circuit 5 extracts the voice signal portions of the voice/audio signals in accordance with the output of the voice section determining circuit 4. The voice signals are thereby extracted and output from the voice signals mixed with the non-voice audio signals.

The audio signal predicting circuit 3 receives the channel divided voice/audio signals, and predicts the audio signals contained in the voice portions from the data of the portions of the audio signals only in accordance with the voice portion detection information output by the voice detecting circuit 2. The audio signal extraction circuit 7 extracts the non-voice audio signal portions from the channel divided voice/audio signals using the voice portion detection information output by the voice detecting circuit 2. Namely, the non-voice audio signal determining circuit 6 receives the voice portion detection information from the voice detecting circuit 2 to determine the non-voice audio signal portions, and the audio signal extraction circuit 7 extracts the audio signal portions in response. An audio signal continuous connecting circuit 8 combines the audio signal portions extracted by the extraction circuit 7 with the audio signal portions predicted by the audio signal predicting circuit 3. Thus, continuous non-voice audio signals are obtained.

SECOND EMBODIMENT

Figure 2:
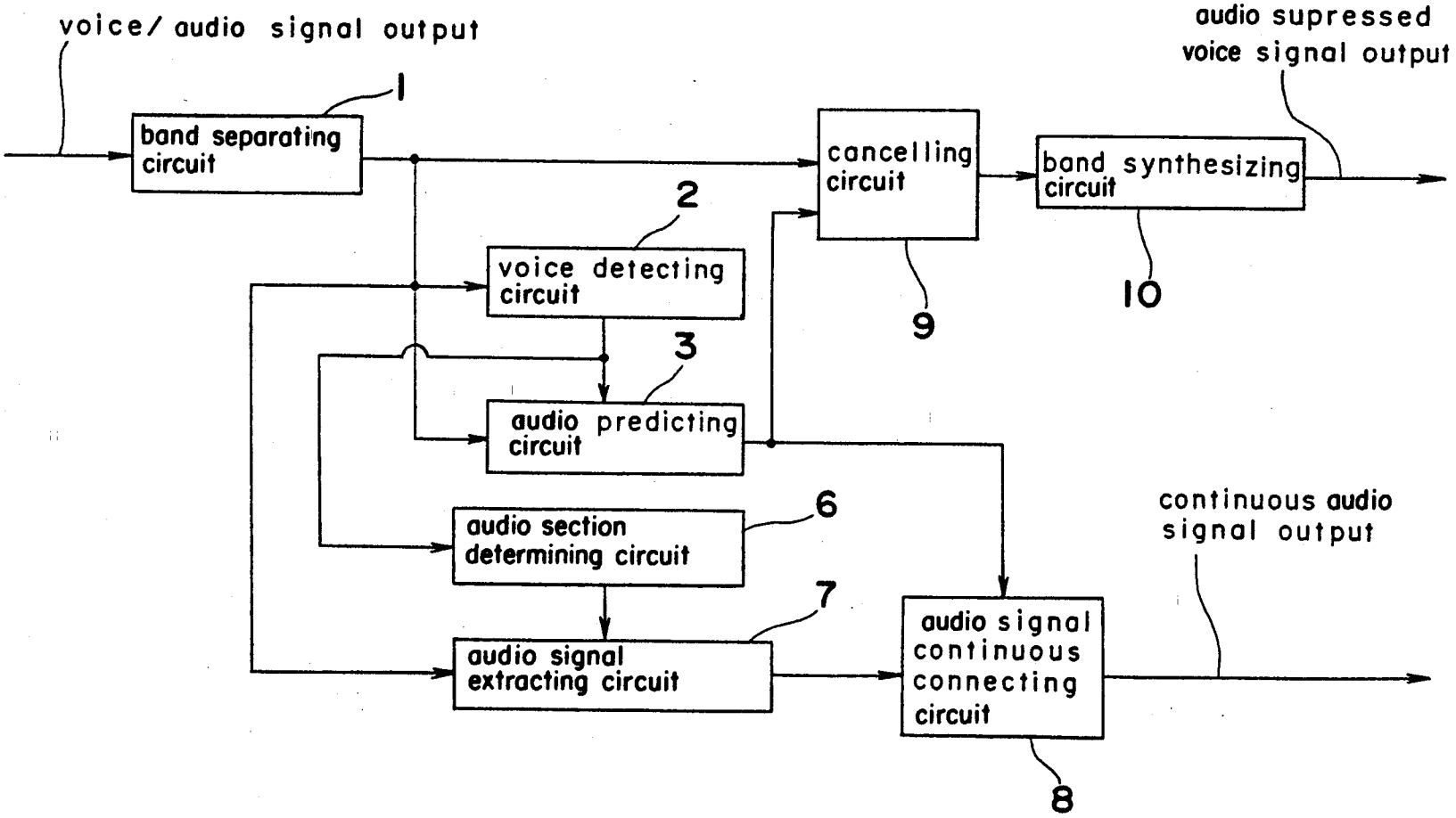
FIG. 2 is a block diagram showing a second embodiment of a voice/non-voice audio signal separation apparatus in accordance with the present invention.

FIG. 2 is a block diagram of a second embodiment of the present invention.

The difference between the embodiment of FIG. 2 and that of FIG. 1 is that in FIG. 2 the non-voice audio signals contained in the voice signal portions are suppressed. Namely, a cancelling circuit 9 and a band compounding circuit or band synthesizing circuit 10 are provided instead of the voice section determining circuit 4 and the voice extraction circuit 5.

Figure 5A:
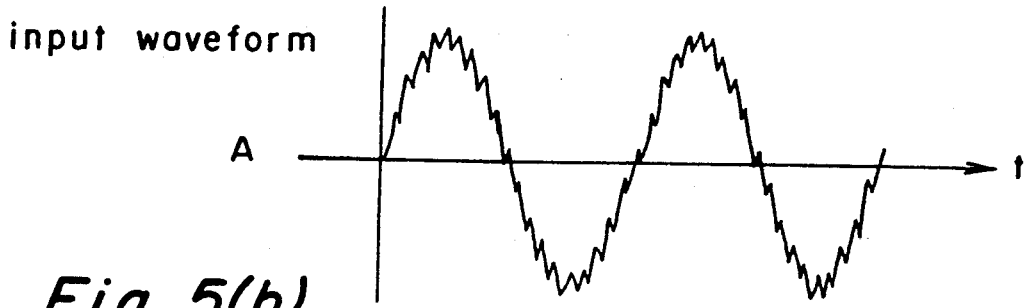
FIGS. 5(*a*)–(*c*) and FIGS. 6(*a*)–(*e*) are graphs for describing a non-voice audio signal cancellation technique of the present invention.
Figure 5B:
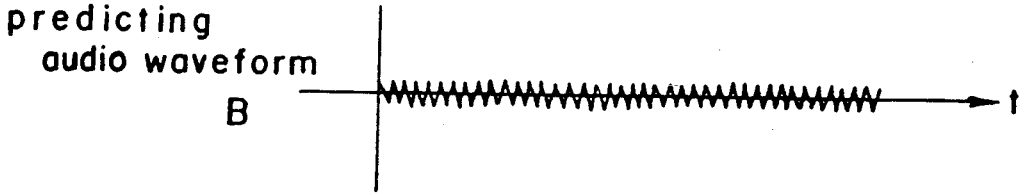
Figure 5C:
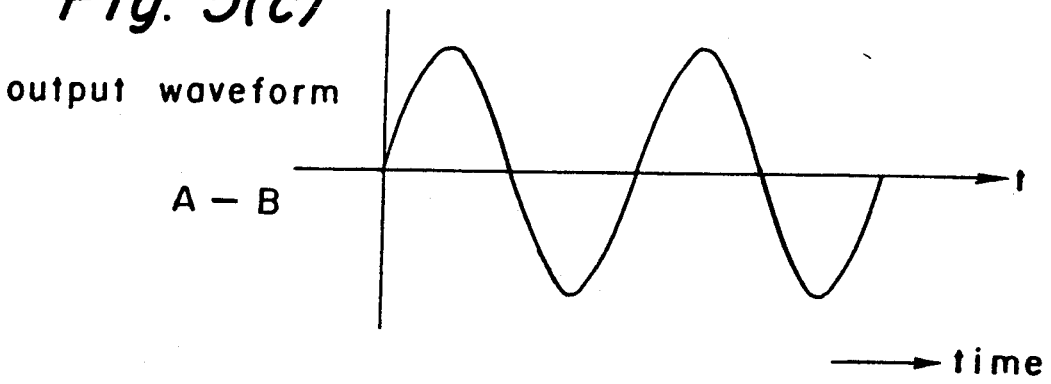
Figures 6A, 6B, 6C, 6D, 6E:
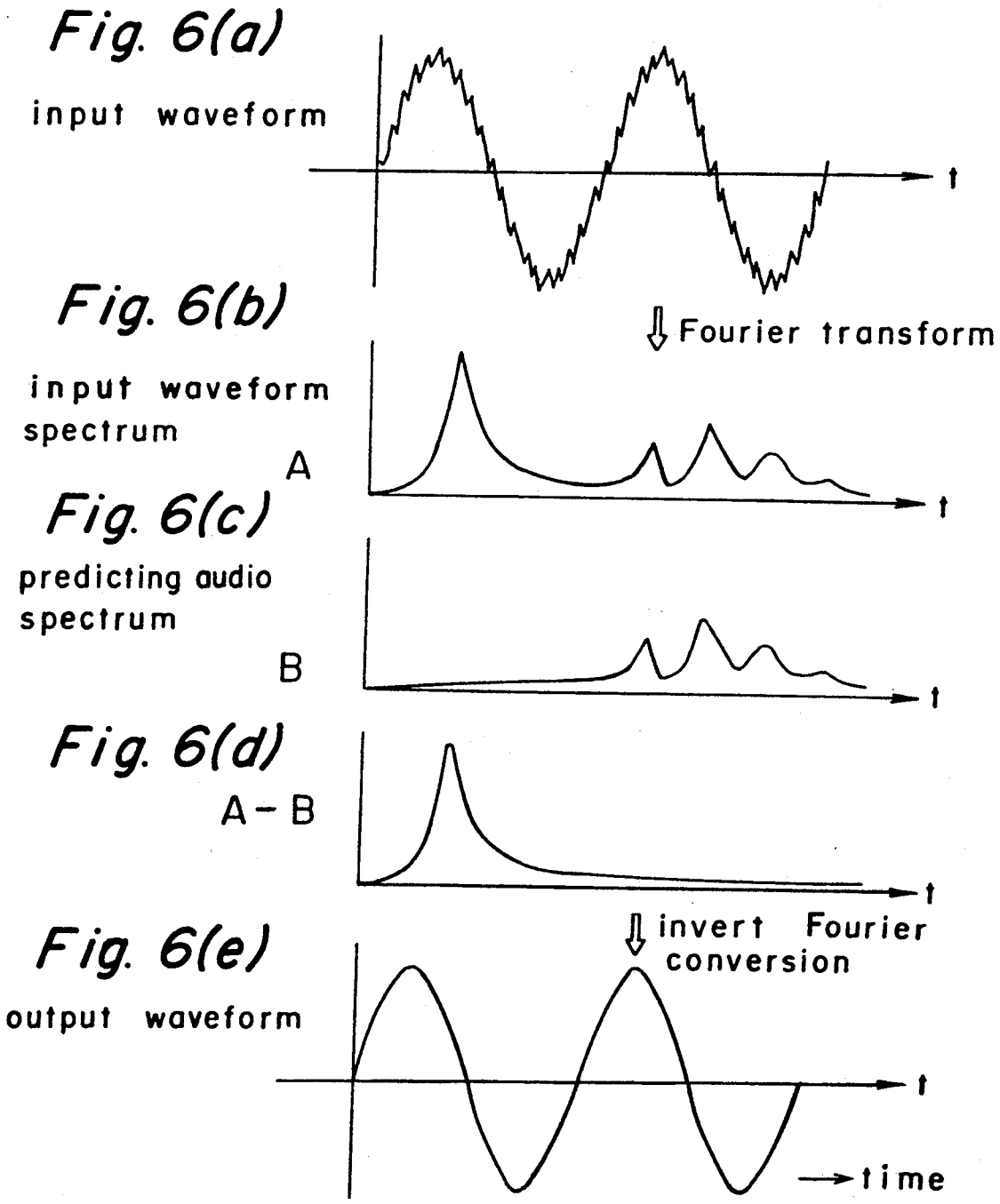

The cancelling circuit 9 receives the channel divided voice/audio signals output by the above described band separating circuit 1 and removes the audio signals predicted by the above described audio signal predicting circuit 3. Generally, as one example of a cancelling method employed by the cancelling circuit 10, the cancellation in the time axis is adapted to subtract the predicted audio signal waveform of FIG. 5(*b*) from the voice/audio signals of FIG. 5(*a*). Thus, only the signals of FIG. 5(*c*) are taken out. As shown in FIG. 6, cancellation can be effected with the frequency being provided as a reference. The voice/audio signals of FIG. 6(*a*) are Fourier factor transformed as shown in FIG. 6(*b*), the spectrum shown in FIG. 6(*c*) of the predicted audio signals is subtracted therefrom as shown in FIG. 6(*d*). The signal of FIG. 6(*d*) is invertly Fourier factor transformed to obtain the audio-signal-free voice signals of FIG. (*e*).

The band compounding circuit 10 effects the reverse Fourier factor transforming operation of the channel signals output from the cancelling circuit 9 so as to obtain a voice signal output of superior quality.

Therefore, the non-voice audio signals contained in the voice signal portions are suppressed so that the voice signals and non-voice signals are separated more precisely.

The various types of circuits described above of the present invention may be realized in terms of computer software, and may even be realized by dedicated hard circuitry.

As is clear from the foregoing description, the voice/non-voice audio signal separation apparatus of the present invention separates and independently outputs non-voice audio signals and voice signals. At a concert, for example, the singing voices and the orchestra instruments may be recorded at the same time using one microphone. The thus mixed signals may be separated into the voice signals and the non-voice audio signals using the apparatus of the present invention. Alternately, the mixed signals may be transmitted using a communication circuit, and then separated at a destination using the apparatus of the present invention.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A signal processing apparatus for separating voice signal portions and non-voice audio signal portions contained in a mixed audio signal, said apparatus comprising:

an input and first and second outputs;

band separation means, operatively coupled to said input, for receiving and channel dividing the mixed audio signal and for outputting a thus channel divided mixed audio signal;

voice signal detecting means, operatively coupled to said band separation means, for detecting voice signals within the channel divided mixed audio signal;

voice segment determining means, operatively coupled to said voice signal detecting means, for determining voice segments of the channel divided mixed audio signal which correspond to the voice signals detected by said voice signal detecting means;

voice signal extracting means, operatively coupled to said input and said voice segment determining means and said first output, for extracting and outputting on said first output the voice signal portions of the mixed audio signal which correspond to the voice segments determined by said voice segment determining means;

non-voice audio signal predicting means, operatively coupled to said band separation means and said voice signal detecting means, for predicting non-voice audio signals contained in the voice signal portions of the channel divided mixed audio signal based on non-voice audio signal portions of the channel divided mixed audio signal output by said band separation means;

non-voice segment determining means, operatively coupled to said voice signal detecting means, for determining non-voice audio segments of the channel divided mixed audio signal which do not correspond to the voice signals detected by said voice signal detecting means;

non-voice extracting means, operatively coupled to said band separation means and said non-voice segment determining means, for extracting and outputting the non-voice audio signal portions contained in the mixed audio signal which correspond to the non-voice audio segments determined by said non-voice segment determining means; and combining means, operatively coupled to said non-voice audio signal predicting means and said non-voice signal extracting means and said second output, for combining and outputting on said second output the non-voice audio signals predicted by said non-voice audio signal predicting means and the non-voice audio signal portions output by said non-voice audio signal extracting means.

2. A signal processing apparatus for separating voice signal portions and non-voice audio signal portions contained in a mixed audio signal, said apparatus comprising:

an input and first and second outputs;

band separation means, operatively coupled to said input, for receiving and channel dividing the mixed audio signal and for outputting a thus channel divided mixed audio signal;

voice signal detecting means, operatively coupled to said band separation means, for detecting voice signals within the channel divided mixed audio signal;

non-voice audio signal predicting means, operatively coupled to said band separation means and said voice signal detecting means, for predicting non-voice audio signals contained in the voice signal portions of the channel divided mixed signal based on non-voice audio signal only portions of the channel divided mixed audio signal output by said band separation means;

cancelling means, operatively coupled said band separation means and said non-voice audio signal predicting means, for removing a signal corresponding to the predicted non-voice audio signal from the channel divided audio signal and for outputting a resultant signal; 'band compounding means, operatively coupled to said cancelling means and said first output, for channel combining the signal output by said cancelling means and for outputting the resultant signal as the voice signal portion on said first output;

non-voice segment determining means, operatively coupled to said voice signal detecting means, for determining non-voice audio segments of the channel divided mixed audio signal which do not correspond to the voice signals detected by said voice signal detecting means;

non-voice signal extracting means, operatively coupled to said band separation means and said non-voice segment determining means, for extracting and outputting the non-voice audio signal portions contained in the mixed audio signal which correspond to the non-voice audio segments determined by said non-voice segment determining means; and combining means, operatively coupled to said non-voice audio signal predicting means and said non-voice signal extracting means and said second output, for combining and outputting on said second output the non-voice audio signals predicted by said non-voice audio signal predicting means and the non-voice audio signal portions output by said non-voice audio signal extracting means.

* * * * *